US005709104A

United States Patent [19]

Howcroft

[11] Patent Number: 5,709,104

[45] Date of Patent: Jan. 20, 1998

[54] COOLING DEVICE FOR INSULATED ICE CHEST

[76] Inventor: Kent Howcroft, 488 N. Brigham Ave., American Fork, Utah 84003

[21] Appl. No.: 603,453

[22] Filed: Feb. 20, 1996

[51] Int. Cl.[6] ..... F25D 3/08

[52] U.S. Cl. ..... 62/457.1; 62/457.9; 62/425; 62/371

[58] Field of Search ..... 62/371, 372, 404, 62/408, 457.1, 457.2, 457.7, 457.9, 165, 168, 425, 186

[56] References Cited

U.S. PATENT DOCUMENTS

| | | | |
|---|---|---|---|
| 1,909,261 | 5/1933 | Frazier | 62/425 |
| 3,633,381 | 1/1972 | Haaf et al. . | |
| 3,971,231 | 7/1976 | Derry . | |
| 4,288,996 | 9/1981 | Roncaglione . | |
| 4,468,932 | 9/1984 | Bullard | 62/425 |
| 4,637,222 | 1/1987 | Fujiwara et al. | 62/457.2 |
| 4,825,666 | 5/1989 | Saia, III . | |
| 4,946,032 | 8/1990 | Stoddard et al. . | |
| 5,111,664 | 5/1992 | Yang . | |
| 5,319,937 | 6/1994 | Fritsch et al. | 62/457.2 |
| 5,329,787 | 7/1994 | Friday . | |
| 5,337,581 | 8/1994 | Lott . | |
| 5,397,010 | 3/1995 | Gibot . | |
| 5,433,085 | 7/1995 | Rogers . | |

*Primary Examiner*—John M. Sollecito
*Attorney, Agent, or Firm*—Thorpe, North & Western, L.L.P.

[57] ABSTRACT

A portable cooling apparatus. The apparatus includes a thermally insulated housing, such as a conventional hand-carried ice chest with a lid for removably covering the main opening. A thermally insulated dry ice chamber is disposed inside the chest. The dry ice chamber is vented and a fan is contained within the chamber. Dry ice is placed in the chamber and sublimates into cold gas which expands and passes from the vented chamber into the chest to cool the chest. Cooling action is increased by selectively actuating the fan to drive the sublimated gas rapidly into the chest, thereby causing air movement within the chest in a circulating flow pattern passing through the ice chamber.

19 Claims, 1 Drawing Sheet

COOLING DEVICE FOR INSULATED ICE CHEST

BACKGROUND OF THE INVENTION

1. The Field of the Invention

The present invention relates generally to refrigeration systems. More particularly, it concerns a portable cooling chest having a temperature control feature.

2. The Background Art

It will be appreciated that conventional methods of maintaining cool temperatures in hand-carried ice chests involve packing the chests with wet ice or dry ice. Both of these options have their disadvantages. For example, the wet ice melts and is often absorbed by food items or packaging carried within the ice chest, making the items wet and soggy. On the other hand, dry ice cools to −97.6 F. which is much too cool for consumer preference. For example, ice cream kept near dry ice will become extremely hard, difficult to serve and less enjoyable to eat for most consumers.

Refrigeration systems are well known for their capacity to provide selectively controllable temperature regulation, and thereby avoid the problems associated with using wet and dry ice. However, such systems typically require expensive components and require substantial external power to operate. The prior art refrigeration units are generally confined to a closed-cycle system which requires a compressor and a motor to cause circulation of a compressed gas. The compressor is used to compress the gas, after which the gas is released into an evaporator coil and allowed to expand. As is well known, the expansion of a gas operates to absorb heat from its immediate environment, thereby cooling it. The expanded gas is channeled from the discharge end of the coil back into the compressor and is compressed again to complete the cycle.

The conventional refrigeration units have not been portable as a result of the equipment required for their operation. The considerable weight of the compressor and motor prevent portability. As such, there has been a long-felt need in the field of refrigeration for a portable, hand-carried cooler which is capable of selective temperature regulation consumes relatively little power and is relatively inexpensive to make.

Several attempts have been made to fill the long-felt need for portable refrigeration units. A dry ice refrigerator is disclosed in U.S. Pat. No. 3,971,231 (granted Jul. 27, 1976 to Derry). The apparent size of the device depicted in the drawings suggests portability. However, the disclosure fails to suggest any temperature regulation feature.

A portable refrigeration device having a temperature control feature is disclosed in U.S. Pat. Nos. 4,288,996 (granted Sep. 15, 1981 to Roncaglione). The Roncaglione patent teaches a cooling chest in which is incorporated a hermetically sealed dry ice containment chamber. The sealed dry ice chamber is disposed in fluidic communication with serpentine cooling coils vented to atmosphere and valved at their output ends. The dry ice sublimates to impose pressure within the containment chamber. In use, the valve is opened to allow free flow of gas sublimating from the dry ice through the coils. The gas expands as it circulates through the coils, thereby withdrawing heat from the interior of the chest to cool the chest. Temperature is thus regulated by selective control of the valve.

Another portable freezer having temperature control is disclosed in U.S. Pat. No. 3,633,381 (granted Jan. 11, 1972 to Haaf et al.). Pressurized gas is stored in a replaceable bottle which is connected to a valved serpentine evaporator tube. Temperature is controlled by selective control of the valve to cause the gas to flow and expand into the evaporator tube.

These prior art portable cooling chests are characterized by a number of disadvantages. Although such prior art portable cooling chests do not require compressors or motors, they still require the expense of pressurized, hermetically contained gases and extensive serpentine tubing. In addition, they lack an effective means for dispersing and circulating the cooled air itself throughout the chest. As such, there remains a long-felt need for a portable cooling chest with selective temperature control which avoids the disadvantages of the prior art cooling devices.

OBJECTS AND SUMMARY OF THE INVENTION

It is an object of the present invention to provide a portable cooling apparatus which is simple in design and manufacture.

It is a further object of the invention to provide such a cooling apparatus capable of selective temperature regulation without use of serpentine evaporator coils or pressurized gases.

It is another object of the invention to provide such a cooling apparatus capable of dispersing and circulating the air within the apparatus.

It is an additional object of the invention, in accordance with one aspect thereof, to provide such a cooling apparatus capable of circulating the air therein in a co-axial movement path.

It is also an object of the invention, in accordance with one aspect thereof, to provide such a cooling apparatus which requires comparatively less power and expense for operation.

The above objects and others not specifically recited are realized in a specific illustrative embodiment of a portable cooling apparatus. The apparatus includes a thermally insulated housing, such as a conventional hand-carried ice chest with a lid for removably covering the main opening. A thermally insulated dry ice chamber is disposed inside the chest. The dry ice chamber is vented and a fan is contained within the chamber. Dry ice is placed in the chamber and sublimates into cold gas which expands and passes from the vented chamber into the chest to cool the chest. Cooling action is increased by selectively actuating the fan to drive the sublimated gas rapidly into the chest, thereby causing air movement within the chest in a circulating flow pattern passing through the ice chamber.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
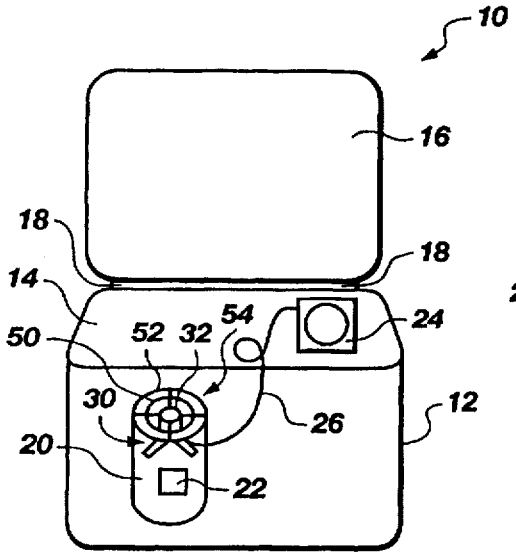
FIG. 1 is a front, perspective view of a portable cooling apparatus made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicant has discovered that a portable refrigeration chest can be made with simple, readily available components to include a selectively controllable temperature regulation feature without the need for compressed gas or serpentine tubing $A_1$. It is further contemplated that the invention might optionally be constructed by simply utilizing a conventional ice chest and incorporating the cooling components and temperature regulation features therein.

Referring now to FIG. 1, there is shown a cooling apparatus, designated generally at 10. The apparatus 10 includes a housing 12 having an interior and a main opening 14. The housing 12 is of a size, weight and configuration conducive for hand-held carrying by a user, and might advantageously comprise a conventional, thermally insulated ice chest. A lid means 16 for removably covering the main opening 14 of the housing 12 is provided, preferably coupled to the housing 12 at hinged attachments 18.

A containment means 20 is disposed within the housing 12 for containing therein a means 22 for altering ambient temperature. The phrase "means for altering ambient temperature" as used herein shall refer to the concept of a means which can alter the temperature of its immediate surroundings regardless of whether such immediate surroundings are hermetically sealed from the atmosphere. In that sense, the classic meaning of "ambient" in an environmental sense may not apply to the phrase.

The means 22 for altering ambient temperature preferably comprises dry ice, although it may alternatively comprise any temperature altering means such as wet ice, cooling coils, heating coils or any other heating or cooling element. The containment means 20 is preferably constructed from thermally insulated material to the degree that dry ice may be kept therein for long periods with minimal effect on temperatures outside of the containment means 20, until sublimated gas from the dry ice is forcibly driven from the containment means 20. More particularly, the containment means 20 comprises thermally insulated walls for inhibiting heat exchange between the containment means and the interior of the housing 12.

A blower means for driving gas from the containment means 20 into the interior of the housing 12 is provided, preferably in the form of a fan 30 having a motor 32. The fan 30 is preferably an electric fan, although it may alternatively include a motor driven by a wind-up spring or any other blower means.

As shown in FIG. 1, the invention preferably includes control means 24 for activating and deactivating the fan 30. The control means 24 is electrically connected to the fan 30 with a control cable 26. The control means 24 may be constructed in any suitable manner known to those of ordinary skill in the art to generate and convey control signals through the cable 26 to the fan 30 to activate and deactivate the fan 30. The control means 24 may be battery operated and would preferably comprise an adjustable temperature sensing thermostat configured and arranged to cause the control means 24 to activate and deactivate the fan 30 responsive to temperature within the housing 12.

Cooling action is increased by selectively actuating the fan 30 to drive sublimated gas from the dry ice 22 rapidly into the housing 12, thereby causing air movement within the housing in a circulating flow pattern passing through the containment means 20. The effect of the fan 30 and the dry ice is to inject cold sublimated gas into the interior of the housing 12 in order to achieve and maintain a desired cooler temperature within the housing 12. Once the temperature has been lowered to a desired range, the fan 30 may be deactivated to inhibit further cooling action until needed.

Figure 2:
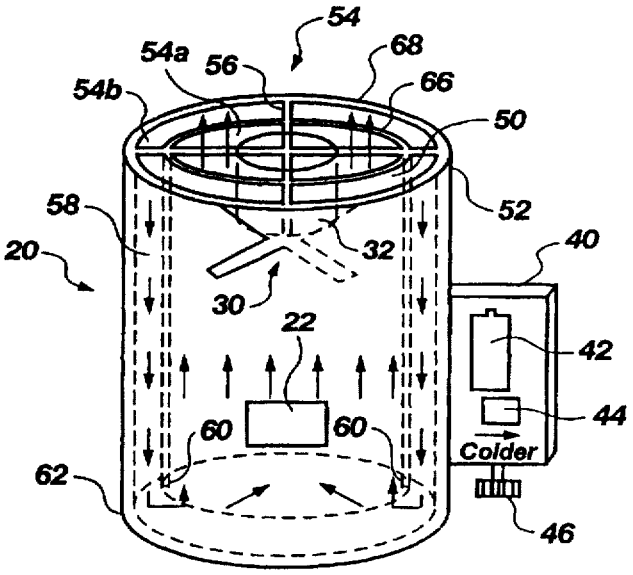
FIG. 2 is a side, perspective view of an alternative ice chamber of the cooling apparatus of FIG. 1.

Referring now to FIG. 2, the containment means 20 may alternatively have an attached control means 40 electrically connected to the fan motor 32. The control means 40 might advantageously include a portable power supply means disposed on or coupled to either the housing 12 or the lid 16 or the containment means 20 for supplying sufficient power to enable the fan 30 to drive the gas within the housing 12. The power supply means may include any suitable power source such as dry cell battery 42 to provide power to the motor 32, the battery preferably having a voltage rated less than twenty volts. The control means 40 includes a controller element 44 which is preferably a temperature sensing thermostat switch as is readily known and understood by those of ordinary skill in the art. A thumbwheel 46 is provided for adjusting the setting of the thermostat switch 44.

The control means 24 of FIG. 1 or the control means 40 of FIG. 2 may comprise any suitable control means, such as a thermal electric switch, a chemical switch, a thermal electronic switch, a thermal magnetic switch, or even a time based duty controller switch. The control means 24 or control means 40 would be preferably designed to permit manual activation and deactivation of the fan 30 by the user, as well as thermostatically controlled activation and deactivation of the fan. More particularly, the control means 24 or 40 comprises adjustable thermostatic means responsive to temperature within the interior of the housing 12 for activating the blower means 30 when the temperature is within a first predetermined range and deactivating the blower means 30 when the temperature is within a second predetermined range.

Referring particularly to FIGS. 1–2, the containment means 20 may comprise a double-walled vessel. The vessel 20 includes inner and outer walls 50 and 52, respectively, and includes a first open end 54 disposed in fluidic communication with the interior of the housing 12. As shown most clearly in FIG. 2, the first open end 54 comprises a central opening **54*a* and an outer circumferential opening 54*b* defined between the double walls 50 and 52. At least a majority of the circumferential opening 54*b* is unblocked to fluidic communication with the interior of the housing 12. A top cover or grid 56 is attached to the open end 54 of the containment means 20 for supporting the fan 30 in suspension therefrom, but the top cover or grid 56 covers substantially less than a majority of the circumferential opening 54***b*.

The circumferential opening 54*b* is part of a double-walled circumferential passage means 58 for channeling gas from the interior of the containment means 20 through the open end 54 and into the interior of the housing 12. The double-walled circumferential passage means 58 is disposed in fluidic communication with the interior of the housing 12 and extends from the interior of the containment means 20 directly into the interior of the housing. The double walls 50 and 52 are preferably disposed in continuous parallel orientation with respect to each other so as to be characterized by an absence of tapered constriction therebetween.

The fan 30 is preferably configured as to the pitch of its blades to drive gas upwardly through the central opening 54*a* into the interior of the housing 12, thereby creating a co-axial movement path of gas within the housing 12 which (a) enters the containment means 20 through the circumferential opening 54*b*, (b) passes downwardly through the double-walled circumferential passage means 58 and radially inwardly around a lower end 60 of the inner wall 50, and (c) moves into contact with the means 22 for altering ambient temperature and then up to the fan 30 which drives the gas out through the central opening 54*a*. This co-axial movement path is depicted by the arrows shown in FIG. 2.

It will be appreciated that the double-walled circumferential passage 58 is at least partially defined by the double walls 50 and 52 of the containment means 20; however, other structure may extend from the double walls 50 and 52 to also form part of the circumferential passage means 58. Whatever structure forms the circumferential passage means 58, it is preferred that such passage means be characterized by an absence of tapered constriction therebetween.

The outer or larger tubular member 52 and the inner or smaller tubular member 50 are disposed in substantially parallel orientation with each other, and the tubular members 50 and 52 terminate in upper or distal ends 66 and 68, respectively. The top cover 56 is mounted upon the distal ends 66 and 68 and operates as a support means for supporting the blower means 30 in suspension such that the blower means 30 hangs downwardly from the support means into the smaller tubular member 50.

Figure 3:
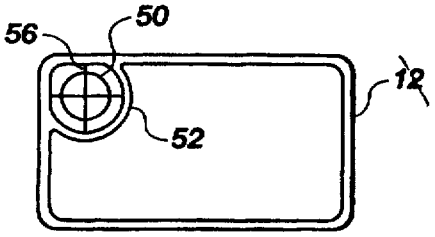
FIG. 3 is a plan view of an alternative embodiment of the cooling apparatus of FIG. 1.

Referring now to FIG. 3, it is noted that the containment means 20 may be incorporated into the housing 12 to form a one-piece member therewith. For example, a molding operation could be achieved wherein the outer wall 52 of the containment means 20 would be molded simultaneously with molding the housing 12.

Figure 4:
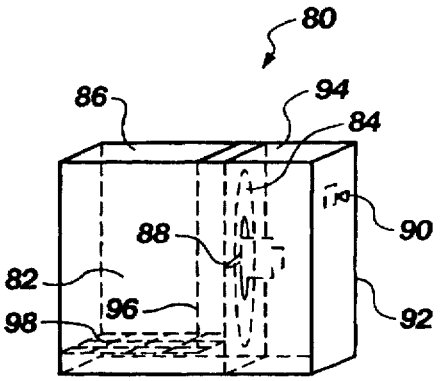
FIG. 4 is a side, perspective view of an alternative embodiment of the ice chamber of FIG. 2.

Referring now to FIG. 4, there is shown an alternative containment means 80 which may be used in lieu of the containment means 20 described above. Similar to the containment means 20, the alternative containment means 80 is intended for use as a dry ice chamber. The containment means 80 includes a first chamber 82 for storing means for altering ambient temperature, such as the dry ice. First and second opposing, non-coaxial open ends 84 and 86 are included such that the containment means 80 defines a gas-flow path from the first open end 84 to the second open end 86. Optionally, the containment means 80 may include an intake chamber 92 having an intake opening 94.

A blower means 88 is included for driving gas along the gas-flow path into the interior of the housing 12. The blower means 88 preferably comprises a fan which would be arranged and controlled in the same manner as described above with respect to the fan 30 of FIGS. 1–2. For example, a thermostat 90 may be provided and electrically connected to the blower means 80. A suitable plenum member 96 may be provided in any manner known to those skilled in the art. A holding grate 98 may be provided for support the dry ice thereon.

Figure 5:
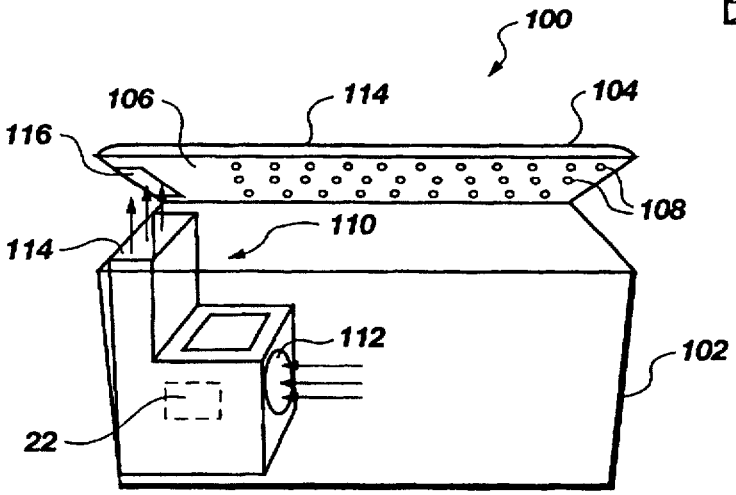
FIG. 5 is a front, perspective view of an alternative embodiment of the cooling apparatus of FIG. 1.

Referring now to FIG. 5, there is shown an alternative cooling apparatus 100, made in accordance with the principles of the present invention. A housing 102 is provided with a hollow lid 104 having an under surface 106 wherein a plurality of apertures 108 are formed. A containment means 110 is provided which operates similar to the containment means 80 of FIG. 4. Dry ice 22 is placed inside the containment means 110, and an internal blower or fan (not shown in FIG. 5) is activated to cause gas to flow into an intake opening 112, into contact with the dry ice 22, and upwardly through a discharge opening 114. With the lid 104 shut, the flowing gas passes through a lid intake opening 116 into the lid 104 and then exits through the apertures 108 back into the housing 102.

Referring to FIGS. 1 and 5, it will be appreciated that the cooling apparatus of the invention is all contained within the housing 12 or 102. Therefore, the blower means 30 of FIG. 1 operates to drive gas from the containment means 20 into the interior of the housing 12 without causing the gas to pass through the walls of said housing. The phrase "causing the gas to pass through the walls of said housing" as used herein shall be construed to refer to the passage of gas actually through a wall, so as to pass from one side of the wall to an opposing side of the wall. Referring to FIG. 5, although gas is driven into the lid 104, which is also a wall member, the gas does not pass through the lid 104 under the definition espoused above because the gas is caused to pass from the under side 106 to the opposing outer side 114 of the lid 104.

In accordance with the disclosure set forth above, a preferred method for cooling an interior of a portable chest having a size, weight and configuration conducive for hand-held carrying by a user, comprises the steps of:

(a) placing ice within a thermally insulated container;

(b) placing the container in fluidic communication with the interior of the chest; and (c) actuating a blower means for driving gas to thereby drive gas from the container into the interior of the housing such that some portions of the ice which have either sublimated or evaporated are thereby driven from said container into the interior of the housing.

Step (c) may further comprise the step of driving gas from the container without causing the gas to pass through walls of the chest. Step (c) may also comprise the step of driving the gas along a coaxial movement path within the container. Step (c) may additionally comprise the step of driving the gas along a non-coaxial movement path from a first open end of the container to a second open end.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover these and any other modifications and arrangements which may be achieved by those having ordinary skill in the art.

What is claimed is:

1. A portable cooling apparatus comprising:

a housing having an interior and a main opening, said housing being of a size, weight and configuration conducive for hand-held carrying by a user;

lid means for removably covering the main opening of the housing;

containment means disposed entirely within the housing for containing therein a temperature altering means for altering temperature, said containment means including at least one air intake opening and at least one air discharge opening; and blower means disposed entirely within the containment means for circulating air along an air movement path through the containment means into the interior of the housing, wherein said blower means is disposed along a portion of the air movement path residing between the temperature altering means and the air discharge opening for contacting air that has been altered in temperature by the temperature altering means and driving said altered air from said air discharge opening into the interior of the housing.

2. The portable cooling apparatus as defined in claim 1, further comprising control means for activating and deactivating the blower means.

3. The portable cooling apparatus as defined in claim 2, wherein the control means comprises adjustable thermostatic means responsive to temperature within the interior of the housing for activating the blower means when said temperature is within a first predetermined range and deactivating said blower means when said temperature is within a second predetermined range.

4. The portable cooling apparatus as defined in claim 1, wherein the containment means comprises thermally insulated walls for inhibiting heat exchange between said containment means and the interior housing.

5. The portable cooling apparatus as defined in claim 1, wherein the blower means comprises a rotational fan disposed within the containment means.

6. The portable cooling apparatus as defined in claim 1, wherein the blower means comprises a portable power supply means coupled to either the housing or the lid means or the containment means for supplying sufficient power to enable the blower means to drive the gas.

7. The portable cooling apparatus as defined in claim 6, wherein the power supply means comprises a battery source having a voltage rated less than twenty volts.

8. A portable cooling apparatus comprising:

a housing having an interior and a main opening, said housing being of a size weight and configuration conducive for hand-held carrying by a user;

lid means for removably covering the main opening of the housing;

containment means disposed within the housing for containing therein a means for altering temperature; and blower means for driving gas from the containment means into the interior of the housing;

wherein the containment means includes a double-walled vessel having a first open end disposed in fluidic communication with the interior of the housing, said first open end comprising a central opening and an outer circumferential opening defined between the double walls and wherein at least a portion of the circumferential opening is unblocked to fluidic communication with the interior of the housing.

9. A portable cooling apparatus comprising:

a housing having an interior and a main opening, said housing being of a size, weight and configuration conducive for hand-held carrying by a user;

lid means for removably covering the main opening of the housing;

containment means disposed within the housing for containing therein a means for altering temperature; and blower means for driving gas from the containment means into the interior of the housing;

wherein the containment means further comprises an interior, an open end and double-walled circumferential passage means for channeling gas from the interior of said containment means through the open end and into the interior of the housing, said double-walled circumferential passage means being disposed in fluidic communication with the interior of the housing and extending from the interior of the containment means directly into said interior of the housing, wherein the double walls are disposed in continuous parallel orientation with respect to each other so as to be characterized by an absence of tapered constriction therebetween.

10. A portable cooling apparatus comprising:

a housing having an interior and a main opening, said housing being of a size, weight and configuration conducive for hand-held carrying by a user;

lid means for removably covering the main opening of the housing;

containment means for containing therein a means for altering ambient temperature, said containment means including a double-walled vessel having a first open end disposed in fluidic communication with the interior of the housing, said first open end comprising a central opening and an outer circumferential opening defined between the double walls and wherein at least a majority of the circumferential opening is unblocked to fluidic communication with the interior of the housing; and blower means for driving gas from the containment means into the interior of the housing.

11. The portable cooling apparatus as defined in claim 10, further comprising control means for activating and deactivating the blower means.

12. The portable cooling apparatus as defined in claim 10, wherein the containment means comprises a larger tubular member and a smaller tubular member disposed inside said larger tubular member in substantially parallel orientation therewith, wherein said larger and smaller tubular members each terminate in a distal end, said apparatus further comprising:

support means mounted upon the distal ends of the tubular members for supporting the blower means in suspension such that said blower means hangs downwardly from said support means into the smaller tubular member.

13. The cooling apparatus as defined in claim 10, wherein the containment means comprises an interior, said apparatus further comprising a double-walled circumferential passage at least partially defined by the double walls of the containment means and being disposed in fluidic communication with the interior of the housing and extending from the interior of the containment means directly into the interior of the housing, wherein the double walls are disposed in continuous parallel orientation with respect to each other so as to be characterized by an absence of tapered constriction therebetween.

14. The cooling apparatus as defined in claim 10, wherein the containment means is disposed within the housing.

15. A portable cooling apparatus comprising:

a housing having an interior and a main opening, said housing being of a size, weight and configuration conducive for hand-held carrying by a user;

lid means for removably covering the main opening of the housing;

containment means including a double-walled circumferential passage, an interior and an open end for containing therein a means for altering ambient temperature and channeling gas through said circumferential passage into the interior of the housing, said double-walled circumferential passage being disposed in fluidic communication with the interior of the housing and extending from the interior of the containment means directly into said interior of the housing, wherein the double walls are disposed in continuous parallel orientation with respect to each other so as to be characterized by an absence of tapered constriction therebetween; and blower means for driving gas from the containment means into the interior of the housing.

16. The portable cooling apparatus as defined in claim 15, further comprising control means for activating and deactivating the blower means.

17. The portable cooling apparatus as defined in claim 15, wherein the open end of the containment means comprises a central opening and an outer circumferential opening defined between the double walls and wherein at least a majority of the outer circumferential opening is unblocked to fluidic communication with the interior of the housing.

18. The portable cooling apparatus as defined in claim 15, wherein the containment means comprises a larger tubular member and a smaller tubular member disposed inside said larger tubular member in substantially parallel orientation therewith, wherein said larger and smaller tubular members each terminate in a distal end, said apparatus further comprising:

support means mounted upon the distal ends of the tubular members for supporting the blower means in suspension such that said blower means hangs downwardly from said support means into the smaller tubular member.

19. A portable cooling apparatus comprising:

a housing having an interior and a main opening, said housing being of a size, weight and configuration conducive for hand-held carrying by a user;

lid means for removably covering the main opening of the housing;

containment means disposed entirely within the housing for containing therein a temperature altering means for altering temperature, wherein said containment means is separate and distinct from the housing for easy hand removal therefrom; and blower means for circulating air through the containment means into the interior of the housing.

* * * * *